United States Patent [19]

Flagg

[11] 4,334,839

[45] Jun. 15, 1982

[54] HAND OPERATED, DUAL CHAMBERED, PNEUMATIC PUMP

[76] Inventor: Rodger H. Flagg, 1415 Lynn Ave., Fort Wayne, Ind. 46805

[21] Appl. No.: 944,847

[22] Filed: Sep. 22, 1978

[51] Int. Cl.[3] ..... F04B 23/06; F04B 33/00

[52] U.S. Cl. ..... 417/536; 92/23

[58] Field of Search ..... 417/521–533, 417/238

[56] References Cited

U.S. PATENT DOCUMENTS

| | | | |
|---|---|---|---|
| 167,366 | 8/1875 | Tyler | 417/533 |
| 636,118 | 10/1899 | Dornatel | 92/23 |
| 658,325 | 9/1900 | Shiles et al. | 417/524 |
| 717,084 | 12/1902 | Denham | 417/238 |
| 1,170,661 | 2/1916 | Myers | 417/429 |
| 1,248,230 | 11/1917 | Williams | 417/426 |
| 1,275,440 | 8/1918 | Johnson | 417/521 |
| 1,332,293 | 3/1920 | Harger | 417/526 |
| 1,390,559 | 9/1921 | Huntley | 417/429 |
| 1,392,928 | 10/1921 | Foss | 417/531 |
| 1,527,226 | 2/1925 | Rollins | 92/23 |
| 2,989,227 | 6/1961 | Statham | 417/238 |
| 3,612,731 | 10/1971 | Tanemoto | 417/533 |

FOREIGN PATENT DOCUMENTS

| | | | |
|---|---|---|---|
| 176689 | 3/1922 | United Kingdom | 417/523 |
| 1054483 | 1/1967 | United Kingdom | 92/23 |

*Primary Examiner*—William L. Freeh

*Attorney, Agent, or Firm*—Rodger H. Flagg

[57] ABSTRACT

A hand operated twin piston air pump, which pumps air under pressure in both directions, that includes a means to disengage pump handles when pumping pressures increase. Thus, twice the volume of air may be readily pumped while pressures are low, and half the piston area may be readily pumped when pressure increases. This speeds up the pumping cycle time and reduces the strokes required to inflate a given product, while not exceeding the designed pumping effort of the user.

4 Claims, 10 Drawing Figures

HAND OPERATED, DUAL CHAMBERED, PNEUMATIC PUMP

BACKGROUND OF THE INVENTION

Double cylinder hand pumps have been generally known to the art for some time, yet their application to high volume, low pressure inflatable products has not been fully realized.

No known provision exists to take advantage of the fact that 75% to 85% of inflated air by volume of a given product, such as an air mattress, or life raft, or the like, is inflated at extremely low pressures, where user could easily increase the volume of air pumped while not exceeding a reasonable effort on behalf of the user.

There are no known hand operated pumps that take advantage of increasing the volume of low pressure air, while providing for a decrease in volume of higher pressure air, to provide for optimizing pumping pressure during the entire inflation cycle without exceeding a predetermined maximum pumping effort.

The uneven distribution of pumping effort of other pump results from designing a pump to supply a given inflation pressure with a given maximum pumping effort, by specifying a fixed piston area, without taking into account that more than half the volume of air is pumped at low pressure. The extra inflation time was not significant while inflating small products such as beach balls or bicycle innertubes, but with larger inflatable products, much time and effort is expended during inflation.

By providing a means to separate pumping action, the size of the piston area can be doubled while pumping pressures are low and the piston area can be reduced in half when increased inflation pressures effect an increase in pumping force, resulting in a large reduction of strokes required to inflate a given object, and a shortening of overall inflation time.

SUMMARY OF THE INVENTION

One of the objects of this invention is to provide a means for readily engaging and disengaging the pump handle, so that two pistons may be simultaneously utilized when pumping pressures are low, and one piston may be utilized when pumping pressures increase.

Another object of this invention is to reduce the time and number of strokes required to inflate a given product by enlarging the piston area while pumping pressures are low, and reducing the piston area as the pressures increase so that a product may be inflated to its designed pressure without exceeding the designed effort of the user. The result is to reduce pumping time and pumping strokes.

Another object of the invention is to design an economical double-chambered air pump with a minimum of parts that is dependable, and is corrosion-resistant to fresh and salt water and the effects of weathering.

A further object of the invention is to design a double-chambered hand operated air pump specifically designed for inflating high volume, low pressure articles.

A further object of the invention is to enlarge the piston diameter to maximize pumping design for a given high volume, low pressure product so that maximum pressures cannot be readily exceeded within the design limitations of the effort of the user, thus eliminating the need for external pressure control to insure against over-inflation, and resultant damage to the inflated product.

DETAILED DESCRIPTION OF THE DRAWINGS

DETAILED DESCRIPTION OF THE INVENTION

Figure 1:
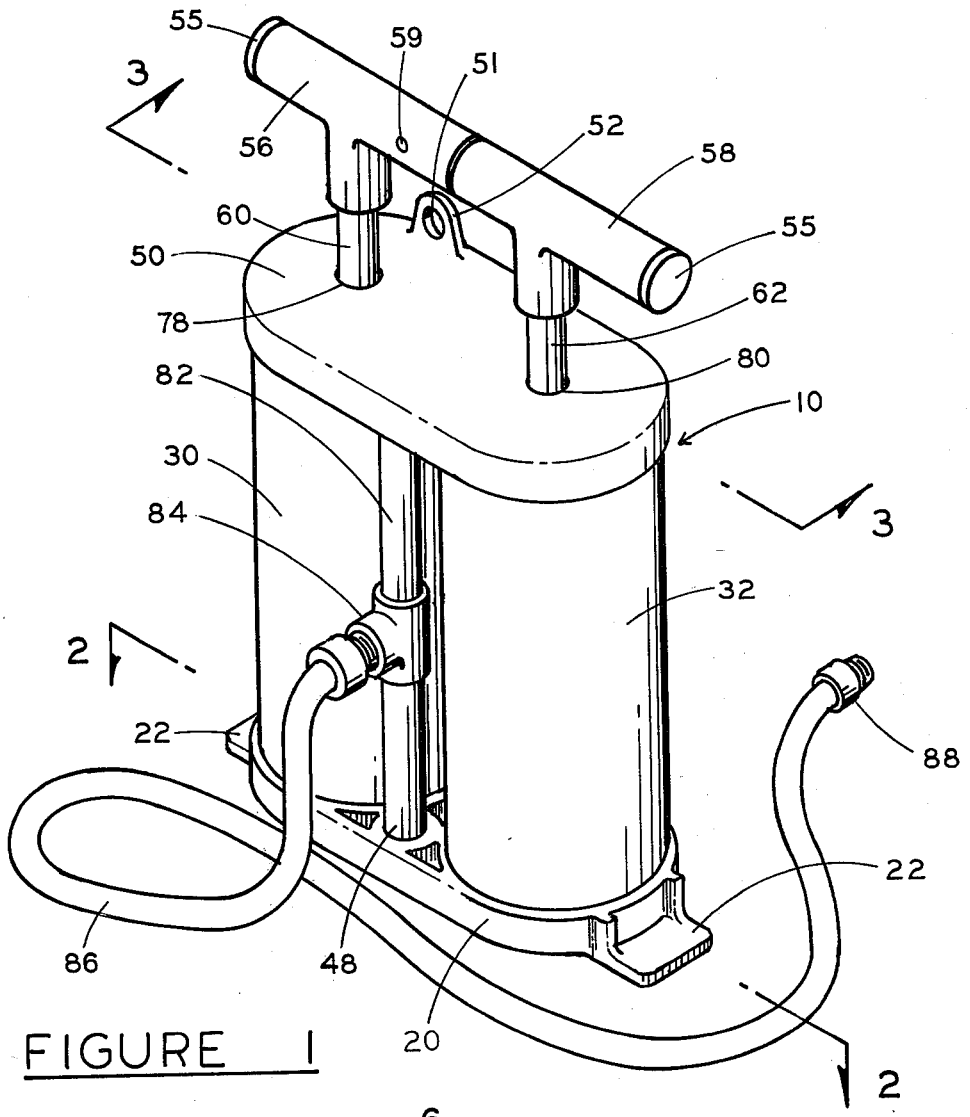
FIG. 1 is a perspective view of the entire invention, showing the pumping handles interconnected during the low pressure inflation stage.

The double cylinder hand operated air pump is designated generally by reference numeral 10 and consists of a base plate 20, including footrests 22, and a pair of cylindrical flanges 24, sized to receive cylinder walls 30 and 32 snugly therein. Structural braces 26 within cylindrical flange 28 act to strengthen the base plate 20, while limiting the penetration of cylinder walls 30,32, so that air may readily escape from inlet port 33 to the interior of cylindrical walls 30,32, through passages 36,38 on the extending stroke; and, so that air may readily escape from within cylindrical walls 30,32 through outlet passages 42,44 to outlet port 40 on the compressing stroke.

Figure 6:
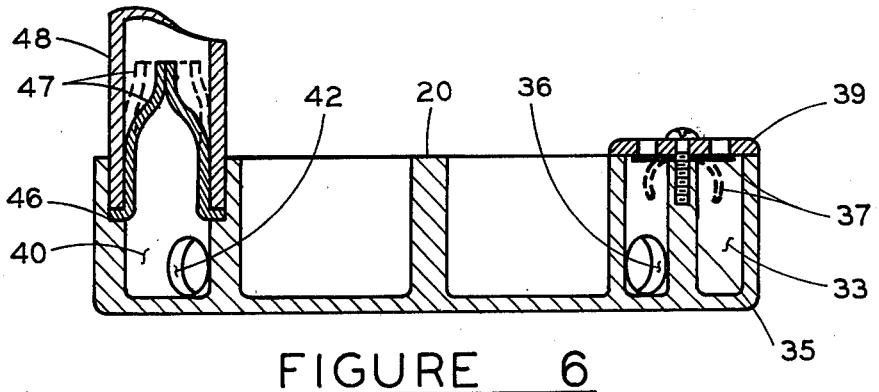
FIG. 6 shows a cross sectional view of a base taken along lines 6—6 in FIG. 2, which includes a preferred oneway valving means for inlet and outlet ports.
Figure 7:
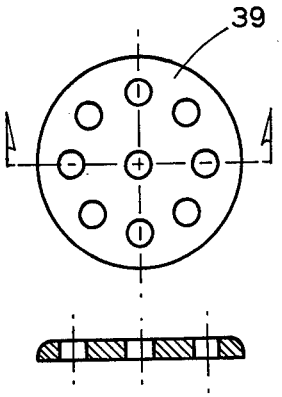
FIG. 7 is a detailed top view of inlet cap, showing air inlet openings.
Figure 8:
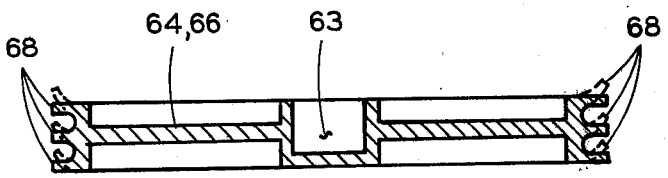
FIG. 8 is a cross sectional view of one piston, showing flexible extensions biased in dash line position by cylinder wall (not shown).

The inlet port 33 includes a boss 35 to secure a thin flexible washer 37 between the boss and the inlet cap 39. The outlet port includes a flange 46 which limits the penetration of outlet tube 48 while securing one way outlet valve 47 between the outlet tube 48 and flange 46, as shown in FIG. 6.

Figure 2:
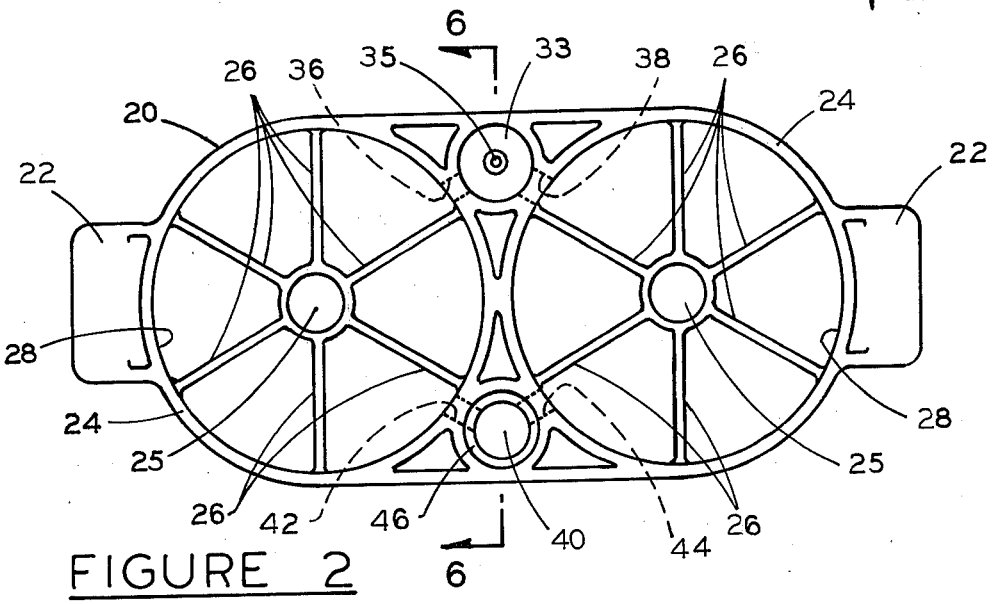
FIG. 2 is a detail view of the base plate, taken along lines 2—2 in FIG. 1, showing the internal configuration of the base plate.
Figure 3:
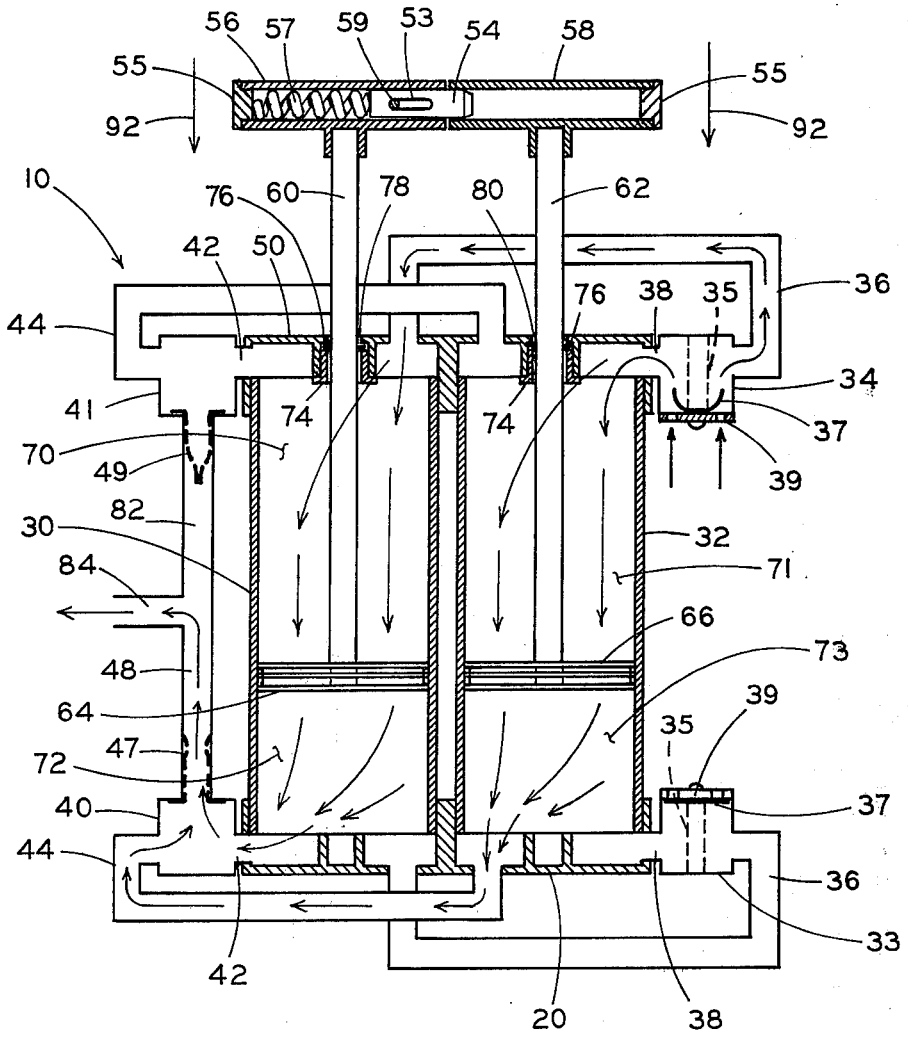
FIG. 3 is a schematic view of the pump in cross section, showing handle engagement and airflow through both cylinders when the handle is depressed.
Figure 5:
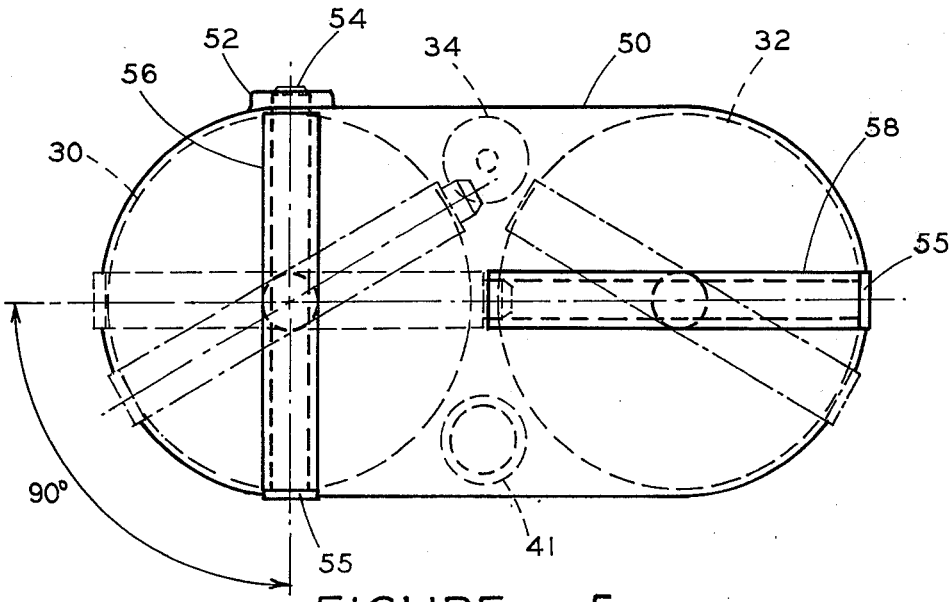
FIG. 5 is a top view of the top plate showing one handle rotated out of position, and locked in place in a boss, while the remaining handle is in position for pumping a single piston. The handles are further shown in dot-dashed lines, rotated horizontally to disengage biased rod.
Figure 4:
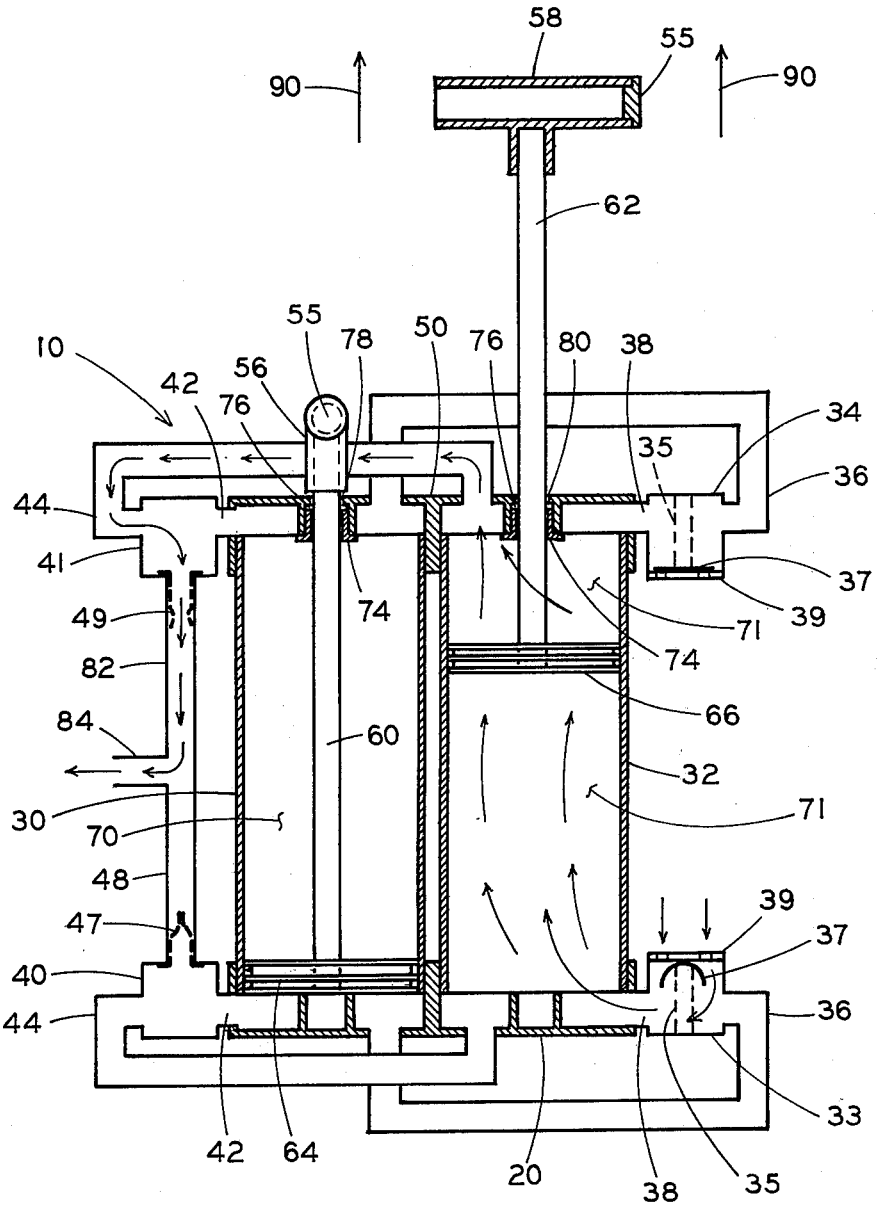
FIG. 4 is a schematic view of the pump in cross section, showing the handles disengaged, with airflow through one cylinder when the handle is extending.

The top plate 50 is similar to the bottom plate as shown in FIG. 2, with the exception that footrests 22 are not needed and openings 78,80 are provided in area 25 for the piston shafts 60,62 to pass therethrough. A boss 52 is also provided on the top plate to receive the biased rod 54 in handle 56 when handle 56 is rotated 90° as shown in FIG. 5.

Within the cylinder walls 30,32 are located pistons 64,66 whose grooved ends 68 flexibly engage the interior of the cylindrical walls, providing sufficient contact to isolate chambers 70,71 from chambers 72,73 during pumping cycles, while adjusting to the uneven interior surfaces of cylinder walls 30,32 so that conventional thin wall plastic or metal tubing may be used for cylinder walls 30,32 without modification to the interior walls.

Openings 63 in pistons 64,66 provide a means to secure pistons 64,66 to piston shafts 60,62.

Figure 10:
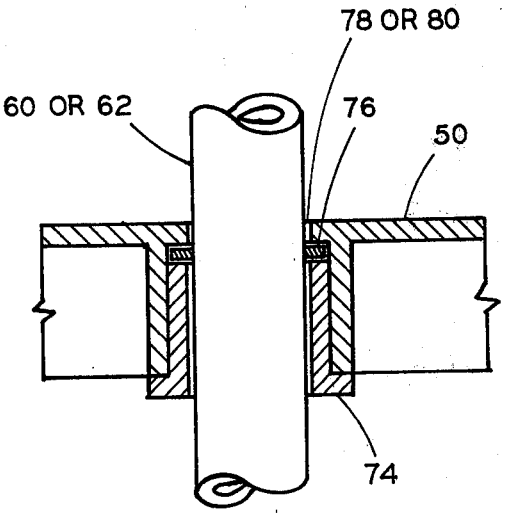
FIG. 10 is an enlarged sectional view of the preferred means for the piston shaft to slideably and sealably pass through the top plate, while providing for manufacturing tolerances and ease of assembly.

A cylindrically flanged insert 74 secures a flexible washer 76 between openings 78,80 in top plate 50 located in area 25, and flanged insert 74. The flanged inserts 74 slideably receive one of the piston shafts 60,62, as the flexible washer 76 seals openings 78,80 by maintaining a close contact with the o.d. of piston shafts 60,62, (FIG. 10).

Inlet port 34 functions in top plate similarly to inlet port 33 in base plate, supplying inlet air to chambers 70,71 when pistons are extended toward base plate 20.

In the preferred embodiment, handles 56,58 are engaged for tandem pumping by biasing rod 54 from handle 56 into handle 58 to interconnect both handles 56,58. An end cap 55 seals interior of handles 56,58 to minimize jamming of biasing rod 54 because of dirt, sand, etc. Spring 57 acts against biasing rod 54 to extend rod 54 beyond handle 56 and when aligned, to enter handle 58 to effectively interconnect handles 56,58 during raising and lowering (vertical movement) of handle to pump air while pressures are low. A pin 59 extends through handle 56 and elongated hole 53 in biased rod 54 to limit travel of biased pin.

To disengage handles 56,58, a (horizontal) twisting action rotates handles 56,58 as shown in FIG. 5 to readily disengage handles. By rotating handles 90° as shown in FIG. 5, handle 56 is locked in position by boss 52 in top plate 50 as biased rod 54 enters opening 51 in boss 52. This allows handle 58 to be thereafter employed in pumping air from one cylinder only.

On the downstroke 92, the outlet air travels from outlet port 40 in the base through one way outlet valve 47 into outlet tube 48.

The one way valve 49 in the top plate remains closed, and outlet air is thus forced through outlet tube 48 into tee 84 through flexible hose 86 to a fitting 88 which is connectible to product to be inflated.

On the upstroke 90, outlet air travels from outlet port 41 in the top cap through one way valve 49 into tube 82. The one way valve 47 located in the base remains closed, and outlet air is forced through tee 84 and flexible hose 86.

A fitting 88 on the outlet end of flexible hose 86 can be adapted to secure the flexible hose to the product being inflated, and can be supplied with a variety of fittings for universal applications, such as innertube valve stem fittings, needle nose (ball) fittings, etc.

Most components of this pump are readily adapted to be molded from plastic or cut to length from standard plastic or metal tubing.

Parts may be secured, where required, by conventional fastening means, including, but not limited to, gluing or sonic welding.

The one-way valving means may include any currently available commercial directional valving means, and may include as a preferred embodiment the flexible washer and flexible closed tube design shown in FIG. 6.

OPERATION OF THE INVENTION

To operate the pump, the user connects flexible hose 86 to the product to be inflated with connection 88. The user then engages pump handles 56,58 by depressing biased rod 54 through opening 51 in boss 52, and rotating handles 56,58 to align and engage biased rod 54 in handle 58, as shown in FIG. 5.

The user then pumps engaged handles 56,58 (vertically), raising and lowering both handles in tandem to pump low pressure air.

On the upstroke 90, air in chambers 70,71 is forced by pistons 64,66 into the outlet port 41 in top plate 50 through outlet passages 42,44 and past one-way valve 49 into outlet tube 82, where air escapes through tee 84 and flexible hose 86 to the product to be inflated.

During upstroke 90, make up air is drawn through inlet port 33 in base 20, which collapses flexible washer 37 as shown by dashed line 31 in FIG. 6, allowing air to enter from inlet port 33, through passages 36,38 into chambers 72,73.

On downstroke 92, air in chambers 72,73 is forced by pistons 64,66 through outlet passages 42,44 in base 20 into outlet port 40, past one-way valve 47 and into outlet tube 48, where outlet air travels through tee 84 into flexible hose 86 to the product to be inflated. During downstroke 92, make up air enters inlet port 34 in top plate 50 by biasing flexible washer 37 to dashed position 37, allowing make up air to be drawn through inlet passages 36,38 into chambers 70,71 in preparation for the reversing stroke.

Figure 9:
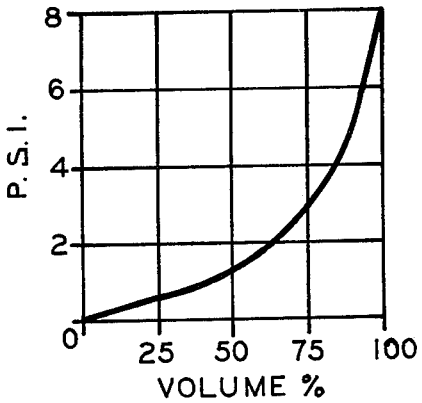
FIG. 9 is a graph showing the ratio of pressure to volume during inflation of a given product.

As the product is inflated, pressures increase as shown in the graph in FIG. 9. When pumping pressures increase, manual effort is increased and the user must exert additional pressure on handles 56,58 to operate the pump. When maximum design force by the user has been reached, the user may disengage handles 56,58 by twisting handles horizontally as shown in FIG. 5, rotating handle 56 approximately 90° to engage biased rod 54 in opening 51 of boss 52. This locks piston 64 in place, providing for use of piston 66 to the exclusion of piston 64, and prevents floating of handle 56.

The user may then continue higher pressure inflation with one cylinder, thus reducing the effort required by the user at each stroke because of the reduction by approximately one-half of the effective piston area.

Since more than half of the product to be inflated is filled with low pressure air, the design doubles the displaced volume of low pressure air at low pressure, thus shortening inflation time and reducing the number of strokes required to inflate a given product. When inflation pressures increase, handle 56 may be locked out of position so that only one cylinder is operational, thus reducing to one-half the effort required to pump air at a given pressure.

This allows the user to complete the higher pressure inflation without exceeding the designed user force limit.

Normally, such a user force limit would be in a range from 10 to 65 pounds.

Since many inflatable products are now on the market, with high volume, low pressure requirements, it is believed that this pump design would have great utility.

Many high volume, low pressure inflatable products have pressure limits on inflation of 3 to 8 p.s.i.

Using 5 p.s.i., and a maximum effort of the user of 45 lbs. it can readily be seen that the first 2 to 2/12 p.s.i. could be inflated with a piston area of 18 sq.in., and the higher pressures from 2½ to 5 p.s.i. can be inflated with 9 sq.in. without exceeding the designed 45 lbs. user unit force. It is also readily apparent that such a design is capable of pumping by hand far greater volumes of air at low pressures, than conventional hand pumps, which rarely exceed 9 sq.in. of piston area.

It is also apparent to one skilled in the art that such a pump could not over-inflate a given product without exceeding the maximum effort of the user, thus ensuring, without external gauging or control means, that the product will not be over-inflated.

Over-inflation of an inflatable product can stretch the material beyond its ability to return to the designed shape, and can rupture the article being inflated, and is a serious problem faced by manufacturers, resulting in claims against the quality of their products.

By specifying and supplying a pump that is designed to maximize inflation while limiting maximum pressures to a designed limit based on the maximum designed limit of the user's effort, a manufacturer can insure against over-inflation while providing for maximum inflation speed, and a minimum of strokes required for a given product.

It is understood that while a preferred embodiment of the handle engaging and disengaging means has been shown, other means, including but not limited to, a bar passed through both handles, a sleeve slideably engaging both handles, a rotating action of the handles to engage and disengage ends of the handles, pinning the handles, a telescoping of the handles, or the rotating of a bar from one handle to the next within the grip of the user, are all intended to be included within the scope of this disclosure and claims.

DEFINITIONS

TANDEM:

For purposes of this specification, tandem is intended to mean: in association or partnership; moving together, conjointly; operationally coupled; and is not intended to mean one element following behind the other.

Although the present invention has been illustrated and described in connection with a few selected example embodiments, it will be understood that these are illustrative of the invention and are by no means restrictive thereof. It is reasonably to be expected that those skilled in this art can make numerous revisions and adaptations of the invention and it is intended that such revisions and adaptations will be included within the scope of the following claims.

What is claimed is:

1. An inflating apparatus comprising:

a plurality of cylinders;

a plurality of pistons, each piston being reciprocably driven by a piston rod in a respective cylinder; each of said pistons being in sliding contact with its respective cylinder wall to form a first chamber on one side of said each piston and a second chamber on the other side of said each piston opposite to said one side; each of said first and second chambers being volumetrically variable and proportional to the axial position of its respective piston in its cylinder;

first means comprising a check valve for admitting fluid to each of said first chambers upon movement of the respective pistons in one direction that volumetrically enlarges said first chambers;

second means comprising a check valve for exhaust of fluid from said first chambers upon movement of the respective pistons in a second direction opposite to said one direction that volumetrically reduces said first chambers;

a plurality of elongated handles, a handle being attached to each said piston rod and each handle having a portion extending transversely from said rod to provide for manual force application to reciprocate each piston in its respective cylinder;

third means for longitudinally aligning and releasably holding said handles in longitudinal alignment whereby said handles may be conjointly operated and move their respective piston rods and pistons in unison, and for releasing said handles from one another whereby said handles are manually movable independently of one another, to provide a variable flow inflating apparatus, wherein said third means comprises means for rotating each of said handles about its respective piston rod axis into mechanically held transverse longitudinal alignment, and to rotate said handles out of said mechanically held alignment by releasing said handles from one another, whereby said handles may be moved independently of one another, wherein said handles are rotatable about their respective piston rod axis into and out of said mechanically locked alignment; one of said handles being rotatable into a predetermined axial position from said longitudinal alignment; and a fourth means for releasably holding said one handle in said predetermined axial position, to provide interference-free operation of the other handle.

2. The apparatus of claim 1 wherein one handle has a holding member slidably related thereto and said holding member having a portion extendable beyond the handle end; said portion being retractably extendable to hold the abutting end of a second handle in fixed relation to said one handle when said handles are in longitudinal alignment, whereby said portion may be selectively moved to hold said handles in longitudinal releasably held alignment to selectively engage or disengage said handles for joint or separate actuation.

3. The apparatus of claim 1 including a member receiver supported in fixed relation to said cylinders to releasably hold said one handle in a rotated position so that said one handle is noninterfering with the operation of the other handle.

4. A dual chamber, variable volume, variably pressurizing hand operated air pump for inflating articles, which comprises:

(a) a base plate with dual flanges for receiving the dual chamber walls;

(b) a top plate with dual flanges for receiving the opposite ends of the dual chamber walls;

(c) individual pistons slideably engaged within the inner wall of each chamber to alternately expand and compress opposite ends of each of the dual chambers during operation of the pump;

(d) piston shafts secured one to each piston and extending slideably and sealingly through openings in the top plate;

(e) common inlet ports, one located in the base plate and one in the top plate, to receive inlet air from the atmosphere;

(f) passages interconnecting each inlet port to the dual chambers;

(g) a one-way valve located within each inlet port to provide inlet air from the atmosphere to the dual chambers as the chambers expand, while restricting passage of compressing air from the dual chamber;

(h) outlet ports, one located in the base plate and one in the top plate;

(i) passages interconnecting each outlet port to the dual chambers;

(j) one-way valve located within each outlet port to provide passage of outlet air from the compressing chambers, while restricting passage of inlet air from the expanding chambers;

(k) a tube connecting the outlet port in the base plate with the outlet port in the top plate;

(l) a flexible hose connectible on one end to the tube and on the opposite end to the article to be inflated;

(m) a pair of handles secured one to each of the piston shafts at the end opposite of the piston;

(n) means for interconnecting the handles for dual chamber operation, effecting higher volume, lower pressure inflation; and (o) means for disconnecting and securing one of the handles for single chamber operation, effecting lower volume, higher pressure inflation.

* * * * *